US005773097A

United States Patent [19]

Rogari

[11] Patent Number: 5,773,097

[45] Date of Patent: Jun. 30, 1998

[54] VERTICAL ELECTROSTATIC COATER HAVING VORTEX EFFECT

[75] Inventor: Joseph Rogari, Trumbull, Conn.

[73] Assignee: Nordson Corporation, Westlake, Ohio

[21] Appl. No.: 636,064

[22] Filed: Apr. 22, 1996

Related U.S. Application Data

[63] Continuation of Ser. No. 249,839, May 26, 1994, abandoned.

[51] Int. Cl.[6] ..... B05D 1/24; B05D 7/20; B05B 5/025

[52] U.S. Cl. ..... 427/459; 427/475; 427/482; 427/486; 118/630; 118/634; 118/DIG. 5

[58] Field of Search ..... 427/459, 460, 427/472, 474, 475, 482, 485, 486; 118/629, 630, 633, 634, 621, DIG. 5

[56] References Cited

U.S. PATENT DOCUMENTS

| | | | |
|---|---|---|---|
| 3,326,182 | 6/1967 | Inoue . | |
| 3,396,699 | 8/1968 | Beebe et al. . | |
| 3,822,140 | 7/1974 | Gyarmati et al. | 118/DIG. 3 |
| 3,916,826 | 11/1975 | Knudsen . | |
| 4,008,685 | 2/1977 | Pierce . | |
| 4,011,832 | 3/1977 | Westervelt et al. . | |
| 4,035,521 | 7/1977 | Westervelt et al. | 427/482 |
| 4,100,883 | 7/1978 | Lupinski et al. . | |
| 4,606,928 | 8/1986 | Dunford et al. | 427/482 |
| 4,729,340 | 3/1988 | Zeiss et al. . | |
| 4,808,432 | 2/1989 | Hajek . | |

FOREIGN PATENT DOCUMENTS

| | | |
|---|---|---|
| 52-42281 | 4/1977 | Japan . |

OTHER PUBLICATIONS

"Powder breakthrough in wire coating market predicted within two years", D. J. Gillette Can. Paint & Finishing, Jun. 1975, pp. 24–25.

*Primary Examiner*—Shrive Beck
*Assistant Examiner*—Fred J. Parker
*Attorney, Agent, or Firm*—Ira S. Dorman

[57] ABSTRACT

The electrostatic fluidized bed coating apparatus and system employ a vertically extending gaseous vortex of charged particles. Effects of variations in particle distribution, size, and electrostatic charge strength are minimized by the vertical orientation, enabling the production of coatings of exceptional uniformity. The apparatus is especially suited for construction to simultaneously coat a number of strands of wire or the like.

6 Claims, 2 Drawing Sheets

VERTICAL ELECTROSTATIC COATER HAVING VORTEX EFFECT

This is a continuation of application(s) Ser. No. 08/249,839 filed on May 26, 1994, now abandoned.

BACKGROUND OF THE INVENTION

A technique that is now widely used for insulating wires and other electrical conductors entails the exposure of a grounded workpiece to a cloud of electrostatically charged fusible particles, for deposit and subsequent integration. Typical of apparatus used for that purpose is the device disclosed and claimed in Knudsen U.S. Pat. No. 3,916,826, and highly effective electrostatic fluidized bed coating equipment and systems are commercially available from Electrostatic Technology, Inc., of Branford, Conn.

A well-recognized problem associated with electrostatic fluidized bed coating concerns the achievement of a uniform build upon the workpiece. When the workpiece is oriented horizontally the problem is most significant from the standpoint of top-to-bottom uniformity, the lower surfaces tending to develop a heavier build than the upper ones. This is attributed to two effects; i.e., rarefaction, or progressive decrease in the density of particle distribution upwardly over the bed, and reduced electrostatic charge strength due to increasing remoteness from the voltage source and/or to dissipation of the initial charge.

The prior art has recognized these limitations of electrostatic fluidized bed coating, and has provided various improvements. One effective approach is described in U.S. Pat. No. 4,606,928, to Dunford et al, wherein a horizontally oriented vortex effect is established within a article cloud. Similarly, in U.S. Pat. No. 4,808,432 Hajek discloses an electrostatic powder coating unit in which a tubular cloud of charged particles moves helically through a horizontally disposed porous cylindrical member.

It is of course common practice to mask a workpiece for build-control purposes, as by interposing a physical barrier between it and the particle cloud. In the case of a wire, this may be done by passing the wire through a tubular member, the extension of which may be altered to vary effective exposure in the coating chamber, as described for example in Beebe et al U.S. Pat. No. 3,396,699. Similar masking techniques have been employed for vertical coating, as in Pierce and Westervelt et al U.S. Pat. Nos. 4,008,685 and 4,011,832, respectively, the latter showing concurrent coating of two wires.

Guns and nozzles are also commonly used for electrostatic coating, and it has been proposed by Zeiss et al, in U.S. Pat. No. 4,729,340, to employ several guns at spaced positions across a booth to simultaneously coat a plurality of elongated wires, the booth being compartmentalized. by partitions. An electrostatic spray device is described by Inoue in U.S. Pat. No. 3,326,182, which includes a housing for directing a gas stream toward a surface to be sprayed; radially inclined apertures are used to introduce ionized particles into a discharge chamber of the housing, so that the axially propagated spray from a coaxial nozzle is displaced spiroidally in a vortex.

SUMMARY OF THE INVENTION

Despite the activity evidenced by the foregoing, a need remains for an apparatus and system for electrostatically depositing powder coatings of improved continuity and thickness uniformity. It is therefore a primary object of the present invention to provide a novel apparatus and system by which workpieces, and particularly conductors of continuous length, can quickly, efficiently, and safely be coated by electrostatic powder deposition to achieve high degrees of continuity and uniformity in the build.

It is also an object of the invention to provide such an apparatus and system which are especially well suited for the concurrent coating of multiple strands of wire or the like.

A further object of the invention is to provide a novel coating unit having the foregoing features and advantages, which is of uncomplicated construction and is relatively inexpensive and facile to manufacture, maintain and operate.

It has now been found that certain of the foregoing and related objects of the invention are attained by the provision of electrostatic fluidized bed coating apparatus, the apparatus being comprised of a housing, including opposed upper and lower end walls and at least one partition disposed generally vertically therebetween. A generally planar, horizontally disposed porous support member lies between the opposed end walls, and defines within the housing a fluidization chamber thereabove and a plenum therebelow. The partition divides the fluidization chamber into a plurality of laterally adjacent compartments, and has a lower marginal portion with a bottom edge that is spaced above the porous support member; the compartments are in fluid flow communication with one another in the space between the support member and the marginal portion of the partition. Portions of the upper end wall overlie the compartments, each portion having an opening aligned with openings in the lower end wall and the porous support member to define workpiece travel paths extending generally vertically through the compartments. A vortex-generating device is spaced upwardly adjacent the porous support member in each compartment, and is adapted to receive a gas and to discharge it in a generally helical flow path substantially in the form of a vortex about, and aligned substantially axially on, at least a portion of the associated travel path. Means is provided for introducing gas into the plenum, for passage upwardly through the support member to effect fluidization of particulate coating material supplied to the chamber, and means is also provided to effect electrostatic charging of the particulate material. Thus, the cooperative effects of fluidization and electrostatic charging may produce separate clouds of electrostatically charged particulate material above the support member in each compartment, and the vortex-generating devices may produce gaseous vortices in which the charged particulate material may be entrained for electrostatic attraction to, and deposit upon, a plurality of workpieces moving along the travel paths through the compartments.

Each vortex-generating device may more specifically comprise a body that defines a generally toroidal internal chamber, a generally circular discharge orifice communicating with the internal chamber and opening in a substantially axial direction, and an inlet communicating with, and having a flow axis disposed generally tangentially to, the internal chamber. The apparatus will preferably include gas-withdrawal structure adjacent the upper end wall portion in each compartment; the structure serves to promote the helical flow of gas about the openings in the upper end wall portion, and cooperates with the vortex-generating device to form a gaseous vortex that extends along substantially the entire length of the workpiece travel path within the compartment.

Other objects of the invention are attained by the provision of a system for electrostatically coating continuous length workpieces. The system comprises the electrostatic fluidized bed coating apparatus herein described, in combination with means for conveying a plurality of continuous length workpieces along the travel paths through the compartments of the coating unit housing.

DETAILED DESCRIPTION OF THE ILLUSTRATED EMBODIMENT

Figure 1:
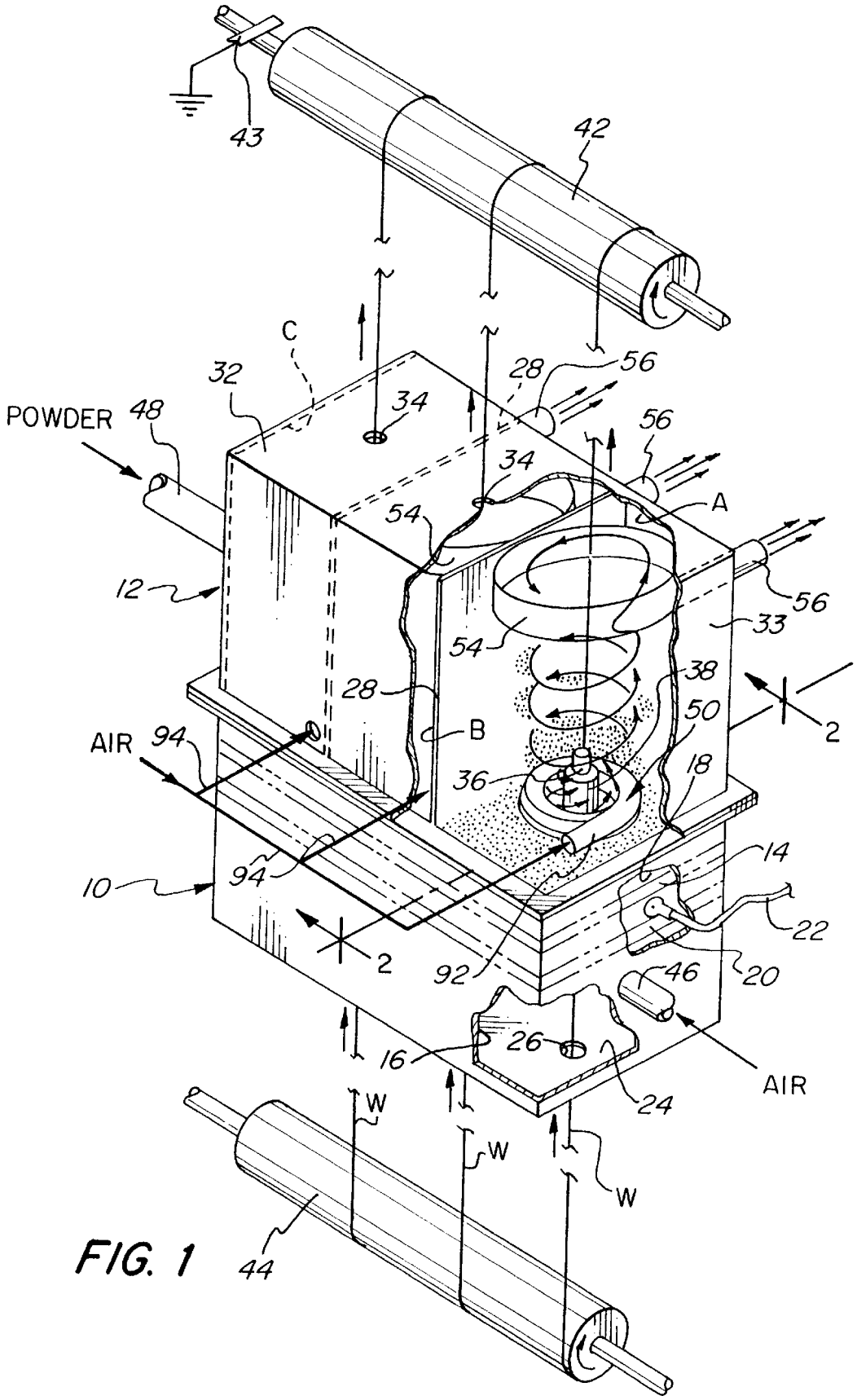
FIG. 1 is a diagrammatic perspective view of an electrostatic fluidized bed coating system embodying the present invention, portions of the coating apparatus being broken away to show internal features.

Turning now in detail to the appended drawings, therein illustrated is an electrostatic fluidized bed coating unit and system embodying the present invention. The coating unit includes a rectangular housing, consisting of a base enclosure and a cover enclosure, generally designated by the numerals 10 and 12 respectively. A porous support member or plate 14 is disposed generally horizontally in the base enclosure 10, and defines a plenum 16 therebelow and a fluidization chamber 18 thereabove. A porous charging plate 20 is positioned within the plenum 16 below the support plate 14, and is connected to a high voltage source (not shown) by a cable 22; construction of the plates 14 and 20 is well known in the art, and it will be appreciated that any of a variety of different charging arrangements can be employed.

Figure 2:
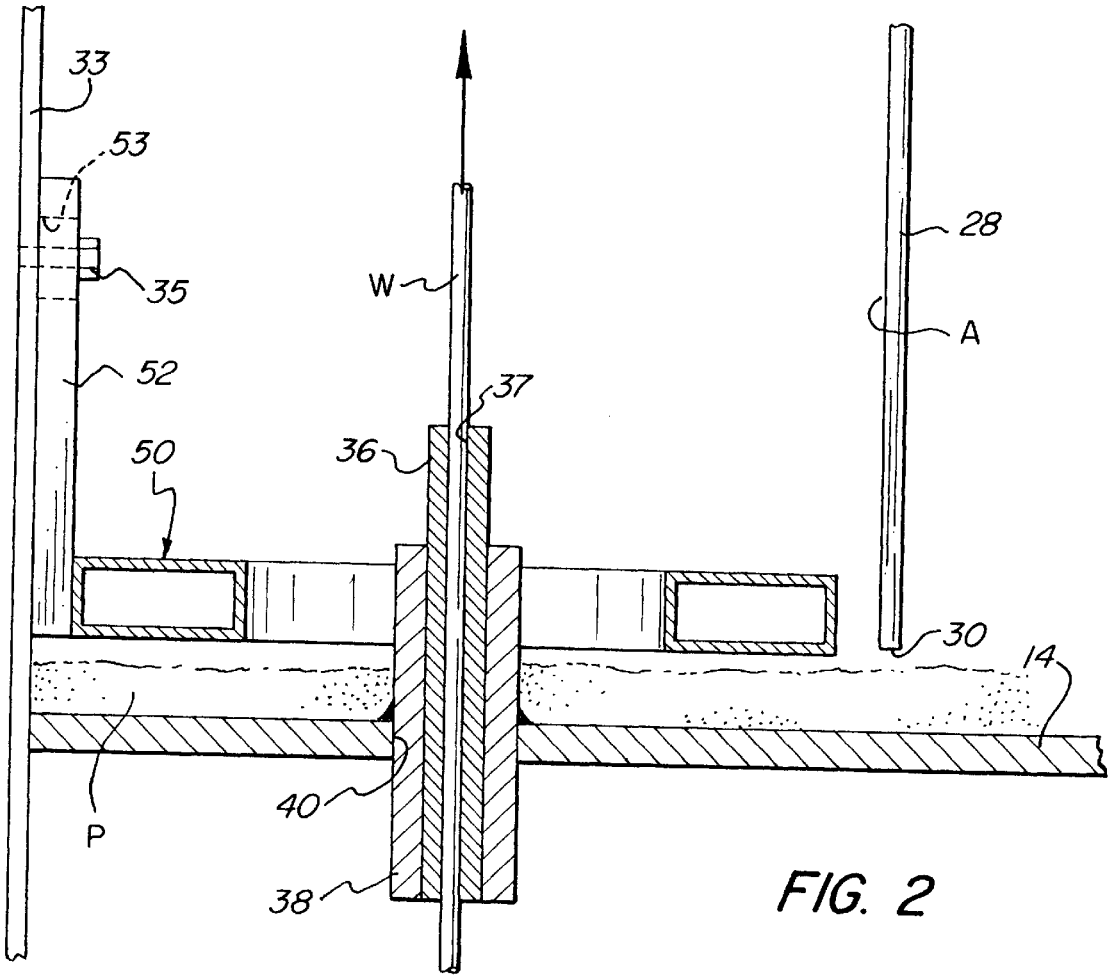
FIG. 2 is a fragmentary, vertical sectional view of the coating unit employed in the system of FIG. 1, taken substantially in the plane of the travel path through one of the compartments thereof.

The fluidization chamber 18 is divided vertically by two partitions 28, thereby defining three substantially independent compartments, designated "A", "B", and "C". As can be seen in FIG. 2, each partition 28 has a lower marginal portion with a bottom edge 30 that is spaced above the upper surface of the support plate 14 (typically by about 1.25 inches), providing powder-flow communication between the adjacent compartments through the spaces thus defined. A tubular guide 36 is supported by a tubular mounting piece 38 within an opening 40 formed through the support plate 14, the bore 37 of which guide 36 is aligned between an aperture 26 in the bottom wall 24 (on the base enclosure 10) and an aperture 34 in the top wall 32 (on the cover enclosure 12). The guide 36 is frictionally engaged for axial adjustment within the piece 38, which is welded to the plate 14 (the components involved being of plastic construction). The guide tube assemblies and aligned apertures define travel paths through the compartments A, B, and C for wire workpieces "W", which are transported therethrough by take-up and pay-off mechanisms 42 and 44, respectively; it will be noted that the mechanism 42 is grounded at 43, so as to in turn ground each of the wires W.

Air is introduced into the plenum 16 through the conduit 46, and coating powder "P" is introduced into the fluidization chamber 18 through the conduit 48; the powder flows under the partition edges 30 to distribute over the entire surface of the plate 14. Fluidization air introduced beneath and passing through the charging plate 20 is ionized by the high voltage applied thereto, in turn electrostatically charging the particles of powder supported upon the member 14.

Figure 3:
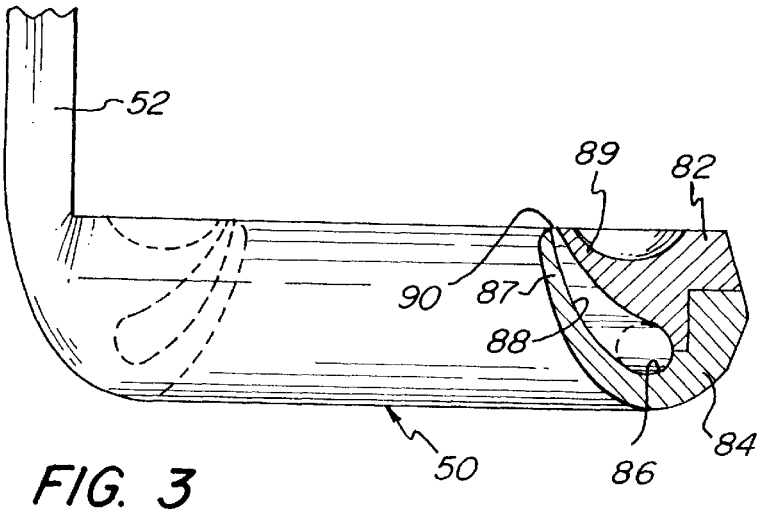
FIG. 3 is an elevational view of one of the vortex-generating devices employed in the coating unit, taken in partial section and drawn substantially to the scale of FIG. 2.

A vortex-generating device, generally designated by the numeral 50, is shown schematically in FIG. 2 and in greater detail in FIGS. 1 and 3. It is supported in position surrounding the guide tube assembly within each compartment (only the generator in compartment A however being visible) by a mounting arm 52, which is fastened to the housing wall 33 by a bolt 35 received in a vertical slot 53; this arrangement allows variation of the spacing of the generator 50 above the support plate 14, as is most important for the production of coatings of high quality. In normal use, the vortex generator will be disposed at, or just above, the surface of the fluidized bed of powder, as determined in the absence of any workpiece.

The vortex generator 50 is seen in FIG. 3 to consist of two shell sections 82, 84, which cooperatively define a toroidal internal passage 86 having a tapered, circumferential throat section 88 between the curved circular lips 87, 89, leading to a continuous circular discharge orifice 90. Extending into the passage 86 is an inlet pipe 92, which intersects therewith in a generally tangential relationship, the outer ends of the pipes 92 for the three generators 50 being connected by lines 94 to a source of air under pressure.

The gas withdrawal structure at the top of each compartment cooperates with the associated vortex generator 50 to promote a helical flow of air. It consists of a circular wall 54 disposed under the upper wall 32, and a tangentially extending exhaust pipe 56. As will be appreciated, the withdrawal structure helps to maintain a gaseous vortex flow along the entire length of the workpiece travel path through the coating compartment.

Fluidization and electrostatic charging of the bed of powder serves to create a separate cloud of charged particles within each compartment A, B and C. Air issuing from the vortex generators 50 proceeds upwardly from adjacent the support member 14, to provide a helical air flow path.forming a vortex 102 about, and substantially coaxial with, each of the wires W. As will be appreciated, the particles of coating material lifted from the bed of powder by the fluidizing air, and comprising the cloud thereabove, become entrained in the helical flow of air issuing from the vortex generator 50 and swirl about the workpiece W, to which they will be attracted by electrostatic forces existing therebetween.

The cloud surrounding each wire is highly homogenous at all levels, and that is thought to be so with respect to particle number and size distribution as well as in respect of the electrostatic charge carried by the individual particles. Although specific values will vary from level-to-level, due primarily to natural rarefaction and distance from the charging element, no appreciable variation is believed to occur within the cloud layer surrounding the wire at any given level. Commencement of helical flow within, or closely adjacent, a dense part of the fluidized bed also appears to promote uniformity and efficiency of coating.

It will be appreciated that the system of the invention will include drive means for the take up roll 42, appropriate support means for the wires (such as idler rolls), etc. Means for heating the conductor and/or the deposit (to effect fusion of the latter), and for effecting cooling (and thus hardening) of the coating subsequent to fusion, may also be provided, as may powder recovery and recycle systems.

Although the vortex-generating devices of the kind illustrated will be preferred in most instances, it will be understood that different forms of generators may be substituted if so desired. Also, while helical flow-promoting outlet structure of the character described is regarded to be highly advantageous, it may not always be necessary (e.g., when the path length is relatively short), and gas exhaust means of different design may be found preferable in certain instances.

The fluidizing gas (normally air) will typically be introduced into the plenum at a rate sufficient to provide about seven to eight cubic feet per minute of air, per square foot. Vortex-creating air will typically be injected at a rate of 75 to 100 cubic feet per hour, to discharge with an angular velocity of about 500 to 3000 feet per minute and a lineal velocity of about 50 to 300 feet per minute. The voltage applied to the electrode will usually be in the range of about 40 to 50 kilovolts, and it will be appreciated that this permits coating with the workpiece closer to the voltage source than might otherwise be the case, without arcing and consequently with enhanced safety. Wire conductors and other elongated workpieces can generally be coated at rates of about 25 to 150 feet per minute, and builds of the coating material ranging from 2 to 40 mils (i.e., 1 to 20 mils in thickness) can readily be achieved with high levels of uniformity; higher production speeds may be achieved as more efficient means for integrating the deposits becomes available.

Although it will generally be preferred to effect electrostatic charging of the particulate coating material by using an ionized fluidizing gas, other means may be substituted, such as may involve direct contact of the particles with an electrode buried in the bed. While the apparatus and system of the invention are especially adapted for the coating of continuous length workpieces (e.g., round and rectangular wire, and metal strip), they may also be employed in certain circumstances for coating individual articles as well. Virtually any particulate or finely divided material that is capable of receiving and retaining an electrostatic charge may be used in the practice of the invention; however, the powder should, in addition, be capable of fluidizing well at an air flow rate of not less than about five cubic feet per minute, per square foot of bed (or porous support plate) area. Such material are will known and constitute an extensive list, including both inorganic and organic resins, the latter typically being a polyolefin, an ethylenically unsaturated hydrocarbon polymer, an acrylic polymer, an epoxy resin, or the like; the coating material employed will normally have a particle size ranging from about 20 to 75 microns, with a bell-shaped curve distribution.

Thus, it can be seen that the present invention provides a novel apparatus and system by which workpieces, and particularly conductors of continuous length, can quickly, efficiently, and safely be coated by electrostatic powder deposition, to achieve high degrees of continuity and uniformity in the build. This in turn enables the production of thinner coatings than would otherwise be the case, by minimizing the need to compensate (by forming overly thick deposits) for dis-continuities or irregularities. The apparatus and system of the invention are especially well suited for the concurrent coating of multiple strands of wire or the like; construction is uncomplicated, and manufacture, maintenance, and operation are relatively inexpensive and facile.

Having thus described the invention, what is claimed is:

1. An electrostatic fluidized bed system for coating a continuous-length workpiece passing upwardly along a vertical travel path portion, comprising: a housing, including opposed upper and lower end walls; a generally planar, horizontally disposed porous fluidizing plate lying between said opposed end walls and defining within said housing a fluidization chamber thereabove and an air plenum therebelow, said upper end wall having an opening therein, and said lower end wall and said porous fluidizing plate having openings therein that are aligned with said opening in said upper end wall to define a workpiece travel path portion extending vertically through said housing; a tubular guide extending vertically through said opening in said fluidizing plate and projecting into said fluidization chamber, said tubular guide having an axial bore therethrough for passage of said continuous length workpiece; a vortex-generating device supported concentrically with respect to said tubular guide above said fluidizing plate in said fluidization chamber, said vortex-generating device being constructed to receive a gas and to discharge it in a generally helical flow path substantially in the form of a vortex about, and aligned substantially axially on, said travel path portion; means for introducing gas into said air plenum for passage upwardly through said fluidizing plate to effect fluidization of a bed of particulate coating material disposed on said fluidizing plate; and means to effect electrostatic charging of such particulate material; wherein, in operation, the cooperative effects of fluidization and electrostatic charging produce a cloud of electrostatically charged particulate material above said fluidizing plate in said chamber, and wherebin said vortex-generating device produces, about said travel path portion, a gaseous vortex in which the charged particulate material is entrained so as to swirl around a continuous-length workpiece, as it travels upwardly along said travel path portion through said fluidization chamber, for electrostatic attraction of the particulate material to, and deposit thereof upon, the workpiece.

2. The system of claim 1 further comprising gas-withdrawal structure adjacent the top of said fluidization chamber and in communication therewith, said a gas-withdrawal structure being constructed for connection to a vacuum source for preventing the escape of particulate coating material from said system and for promoting the helical flow of gas about said opening in said upper end wall, said gas-withdrawal structure thereby cooperating with said vortex-generating device to form a gaseous vortex along the entire length of said workpiece travel path portion within said chamber.

3. The system of claim 1 wherein said tubular guide is mounted for axial adjustment within said opening in said fluidizing plate.

4. The system of claim 1 additionally including means for continuously conveying a continuous-length workpiece upwardly through said housing along said travel path portion.

5. A method for electrostatically coating a continuous-length workpiece with a particulate coating material, comprising the steps:

(a) providing an electrostatic fluidized bed system, comprising: a housing, including opposed upper and lower end walls; a generally planar, horizontally disposed porous fluidizing plate lying between said opposed end walls and defining within said housing a fluidization chamber thereabove and an air plenum therebelow, said upper end wall having an opening therein, and said lower end wall and said porous fluidizing plate having openings therein that are aligned with said opening in said upper end wall to define a workpiece travel path portion extending vertically through said housing; a tubular guide extending vertically through said opening in said fluidizing plate and projecting into said fluidization chamber, said tubular guide having an axial bore therethrough for passage of a continuous length workpiece; a vortex-generating device supported concentrically with respect to said tubular guide above said fluidizing plate in said fluidization chamber, said vortex-generating device being constructed to receive a gas and to discharge it in a generlly helical flow path substantially in the form of a vortex about, and aligned substantially axially on, said travel path portion; means for introducing gas into said air plenum for passage upwardly through said fluidizing plate to effect fluidization of a bed of particulate coating material disposed on said fluidizing plate; and means to effect electrostatic charging of such particulate material;

(b) maintaining above said fluidizing plate a bed of a particulate coating material, the particles of which are capable of acquiring an electrostatic charge;

(c) operating said vortex-generating device so as to so receive and discharge a gas;

(d) operating said means for introducing gas so as to so effect fluidization;

(e) operating said means to effect electrostatic charging so as to effect electrostatic charging of said particulate material; and (f) passing a continuous-length workpiece upwardly along said vertical travel path portion while carrying out said steps (c), (d), and (e); wherein the cooperative effects of fluidization and electrostatic charging produce a cloud of electrostatically charged particulate material above said fluidizing plate in said chamber, and wherein said vortex-generating device produces, about said travel path, a gaseous vortex in which the charged particulate material is entrained so as to swirl around said continuous-length workpiece, as it travels upwardly along said travel path portion through said fluidization chamber, for electrostatic attraction of said particulate material to, and deposit thereof upon, said workpiece.

6. The method of claim 5 wherein said system additionally includes a gas-withdrawal structure adjacent the top of said fluidization chamber and in communication therewith, said gas-withdrawal structure being constructed for connection to a vacuum source; said method including the further step of drawing a vacuum through said gas-withdrawal structure while said steps (c), (d), (e), and (f) are being carried out, thereby preventing the escape of particulate coating material from said system and promoting the helical flow of gas about said opening in said upper end wall of said housing, said gas-withdrawal structure cooperating with said vortex-generating device to form a gaseous vortex along the entire length of said workpiece travel path portion within said chamber.

* * * * *